United States Patent [19]

Takano et al.

[11] Patent Number: 5,065,592

[45] Date of Patent: Nov. 19, 1991

[54] COLD BOX

[75] Inventors: Yoshiaki Takano; Koichi Sato, both of Oizumi; Yutaka Shimose, Menuma, all of Japan

[73] Assignee: Sanyo Electric Co., Ltd., Osaka, Japan

[21] Appl. No.: 566,248

[22] Filed: Aug. 10, 1990

[30] Foreign Application Priority Data

Aug. 11, 1989 [JP] Japan ..... 1-208080
Nov. 17, 1989 [JP] Japan ..... 1-300210

[51] Int. Cl.[5] ..... F25D 17/06

[52] U.S. Cl. ..... 62/180; 62/186; 62/201; 165/10

[58] Field of Search ..... 62/201, 179, 180, 185, 62/186, 213, 229, 226, 430, 437, 203, 161, 163; 165/10 A, 902

[56] References Cited

U.S. PATENT DOCUMENTS

| | | | |
|---|---|---|---|
| 1,954,455 | 4/1934 | Morse et al. | 62/185 X |
| 2,153,696 | 4/1939 | Philipp | 62/185 X |
| 4,248,291 | 2/1981 | Jarmul | 62/430 X |
| 4,587,279 | 5/1986 | Salyer et al. | 165/10 A |

FOREIGN PATENT DOCUMENTS 62-210369 9/1987 Japan .

1-102269 4/1989 Japan .

*Primary Examiner*—Harry B. Tanner
*Attorney, Agent, or Firm*—Darby & Darby

[57] ABSTRACT

A cold box comprising a freezing room, a cold-heat accumulating agent stored in the freezing room, a commodity storing room divided from the freezing room, an evaporator which forms a freezing cycle together with a compressor, a first air-blowing device for circularly supplying cool air for cooling the cold-heat accumulating agent to the freezing room through the evaporator, a second air-blowing device for circularly supplying cool air for cooling the commodity in the storing room through the cold-heat accumulating agent, and an operation control device for directing the compressor, the first air-blowing device and the second air-blowing device to operate, the operation control device comprising temperature setting device for setting one freezing temperature and one storing temperature, first control device for detecting the temperature of the freezing room and directing the compressor to stop operating when the detected temperature is the set freezing temperature or less, and second control device for detecting the temperature of the storing room and directing the second air-blowing device to stop operating when the detected temperature is the set storing temperature or less.

7 Claims, 6 Drawing Sheets

—·—·→ COOL AIR PASSED THROUGH DUCT

- - - - → COOL AIR INTRODUCED INTO STORING ROOM THROUGH OUTLET AND LED TO INLET

COLD BOX

BACKGROUND OF THE INVENTION i) Field of the Invention

The present invention relates to a cold box, and particularly to a cold box which is usually loaded on a truck and carried thereby, which cools a storing room while cooling a cold-heat accumulating agent before the truck starts to run, and which secures that the storing room is cooled by the cold-heat accumulating agent during running.

ii) Description of Related Art

Japanese Patent Laid-Open No. 62-210369 discloses a refrigerator provided with a cold-heat accumulating agent, which is disposed in the body of a heat insulating box, a cooler in the cold box and a freezing cooler for the cold-heat accumulating agent. This publication discloses a technique in that the operation of a compressor is generally controlled by a temperature controller so that the temperature in the cold box is kept at a set temperature, while the compressor is forced to be driven regardless of the opening and closing actions of the temperature controller only during the time taken for freezing the cold-heat accumulating agent.

In the above described prior art, the cooler (a first evaporator) for cooling the inside of the cold box and the cooler (a second evaporator) for freezing the cold-heat accumulating agent are connected in series in a freezing cycle. If the operation of the compressor is stopped, it causes to stop the cooling of the cold box by the first evaporator and of the cold-heat accumulating agent by the second evaporator. Therefore, the compressor must be operated during the time required for freezing the cold-heat accumulating agent. However, the interior of the cold box is uncontrollably cooled, until the cold-heat accumulating agent is frozen. There is thus a problem in that the cold-heat accumulating agent cannot be frozen, while the temperature in the cold box being kept at a temperature within the ice temperature zone, which must be strictly controlled with a narrow control temperature width, i.e, a small allowable temperature difference, for example, about ±0.5° C., for the set temperature.

Japanese Patent Laid-Open No. 1-102269 discloses a cold-heat accumulation type of cold reserving box in which a cold-heat accumulating agent and a cooler are contained. The box disclosed in this publication comprises the body of a cold reserving box comprising a cold-heat accumulating room, in which the cooler containing the cold-heat accumulating agent, a defrosting heater and an air-sending fan are installed, and a cold reserving room for keeping transport commodities such as foods or the like cold, a heat insulating partition which divides the cold accumulating room from the cold reserving room and in which an air hole and a ventilation fan are disposed, and a refrigerator unit disposed on the outside the cold reserving box body near the cold reserving room thereof.

This publication does not disclose whether or not the cold-heat accumulating agent, stored in the cold-heat accumulating room can be discharged from the storing room. If the cold-heat accumulating agent can be discharged from the storing room, the cold reserving box is not designed so that the control temperature of the cold-heat accumulating room containing the cooler can be changed when cold-heat accumulating agents having different freezing temperatures are stored in the cold-heat accumulating room. When the cold-heat accumulating agent having a freezing temperature extremely higher than the control temperature (15° C. or more higher) is stored, the cold-heat accumulating agent is excessively cooled, and the cooling room is also excessively cooled. This inhibits the attainment of a desired temperature and thus creates a danger of deteriorating the quality of the commodities stored in the cold reserving storehouse.

If the cold-heat accumulating agent cannot be discharged from the storing room, when an attempt is made to control the temperature in the cold reserving room to a plurality of temperature zones, the cold reserving room is excessively cooled or insufficiently cooled in some cases.

SUMMARY OF THE INVENTION

The present invention provides a cold box comprising a freezing room, a cold-heat accumulating agent stored in the freezing room, a commodity storing room divided from the freezing room, an evaporator forming a freezing cycle together with a compressor, first air-blowing means for circularly supplying cool air for cooling the cold-heat accumulating agent to the freezing room through the evaporator, second air-blowing means for circularly supplying cool air for cooling a commodity to the storing room through the cold-heat accumulating agent, and an operation control apparatus for directing the compressor, the first air-blowing means and the second air-blowing means to operate. The operation control apparatus comprises a temperature setting means for setting a freezing temperature and a storage temperature, first control means for detecting the temperature in the freezing room and directing the compressor to stop operating when the detected temperature is the set freezing temperature or less, and a second control means for detecting the temperature of the storing room and directing the second air-blowing means to stop operating when the detected temperature is set storage temperature or less.

Namely, in the present invention, the means (the first air-blowing means) for circularly supplying cool air to the cold-heat accumulating agents stored in the freezing room is separated from the second air-blowing means for circularly supplying cool air for cooling the commodities to the storing room. It is therefore possible to separately control the temperature in the storing room and the temperature in the freezing room and thus precisely control the temperatures.

BRIEF DESCRIPTION OF THE DRAWINGS

The drawings shows embodiments of the present invention, in which.

DETAILED DESCRIPTION OF PREFERRED EMBODIMENTS

Figure 1:
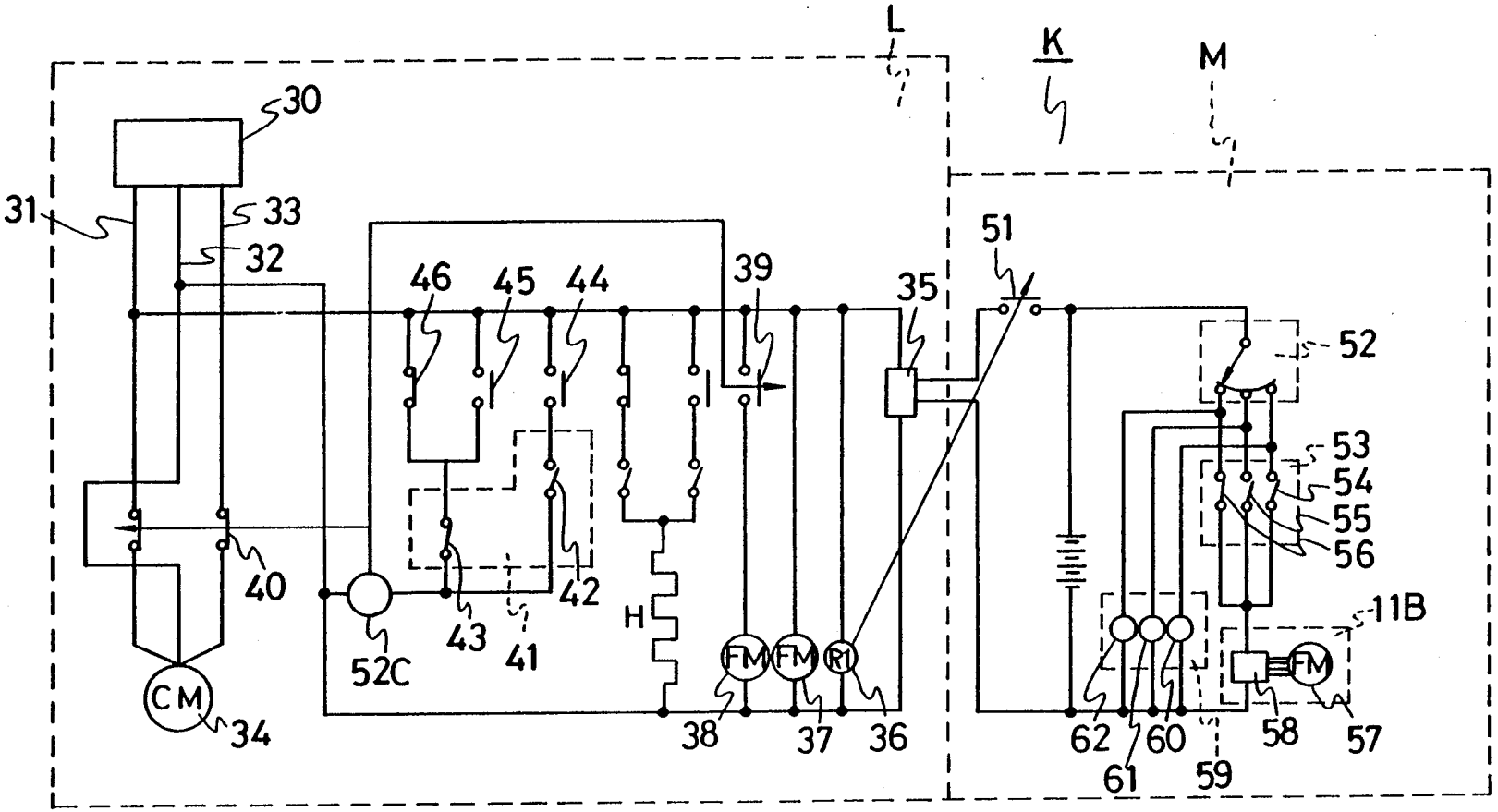
FIG. 1 is a drawing of the operation control circuit in a cold box.

Embodiments of the present invention are described below with reference the drawings.

Embodiment 1

Reference numeral 1 denotes a refrigerator serving as a cold box. This embodiment uses as an example a refrigerator for transport, which is called "cold roll box" and which is employed for transporting commodities loaded on a car such as a truck or the like, while cooling the commodities.

Figure 3:
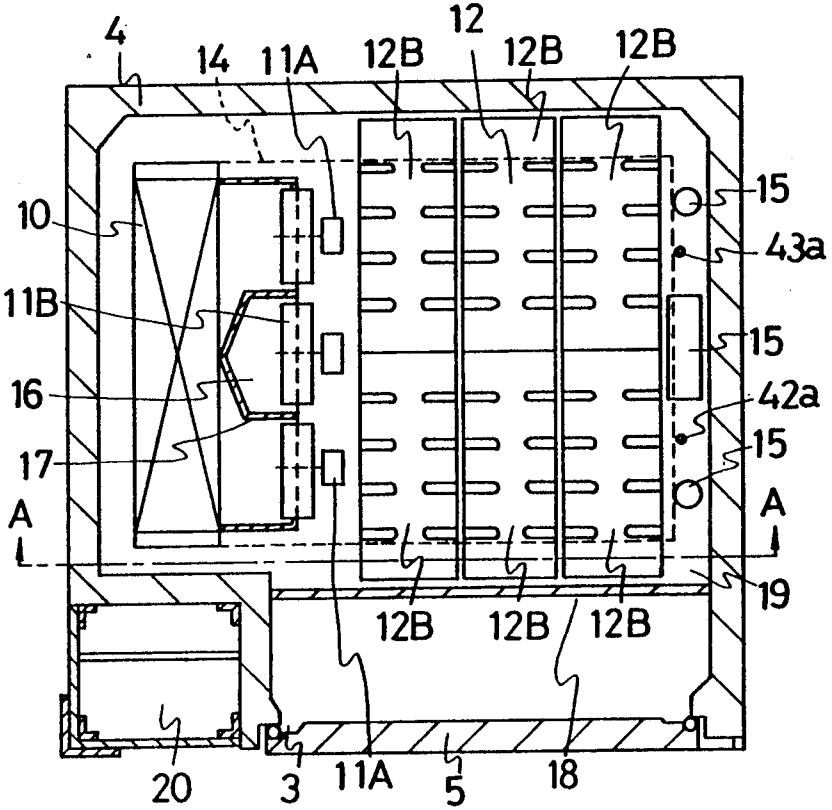
FIG. 3 is a cross-sectional view of a freezing room.
Figure 2:
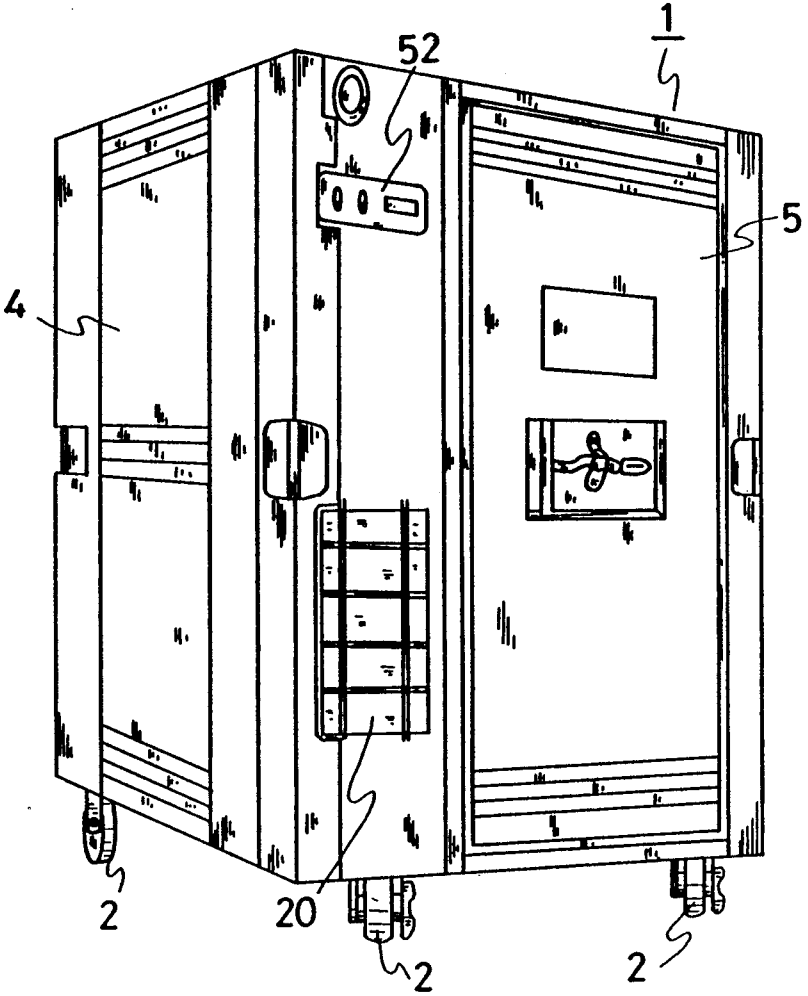
FIG. 2 is a perspective view of the appearance of the cold box.
Figure 4:
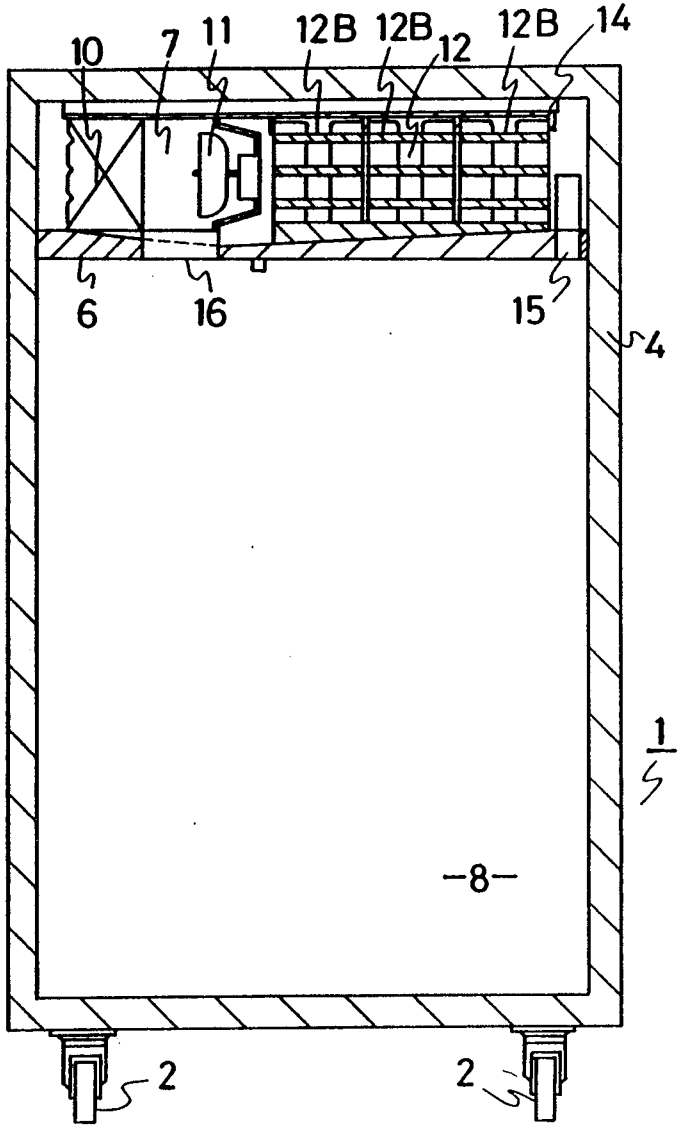
FIG. 4 is a sectional view taken along the line A—A of FIG. 3.

In FIGS. 2 to 4, the refrigerator 1 has wheels at the bottom thereof for moving the refrigerator 1, a heat insulating box 4 having an opening 3, which is formed in one side thereof, and a heat insulating door 5 for closing the opening 3 so that the door 5 can be opened and closed. In the heat insulating box 4 are disposed a freezing room 7 and a specification selecting room 8, which are divided from each other by a partition board 6.

Figure 5:
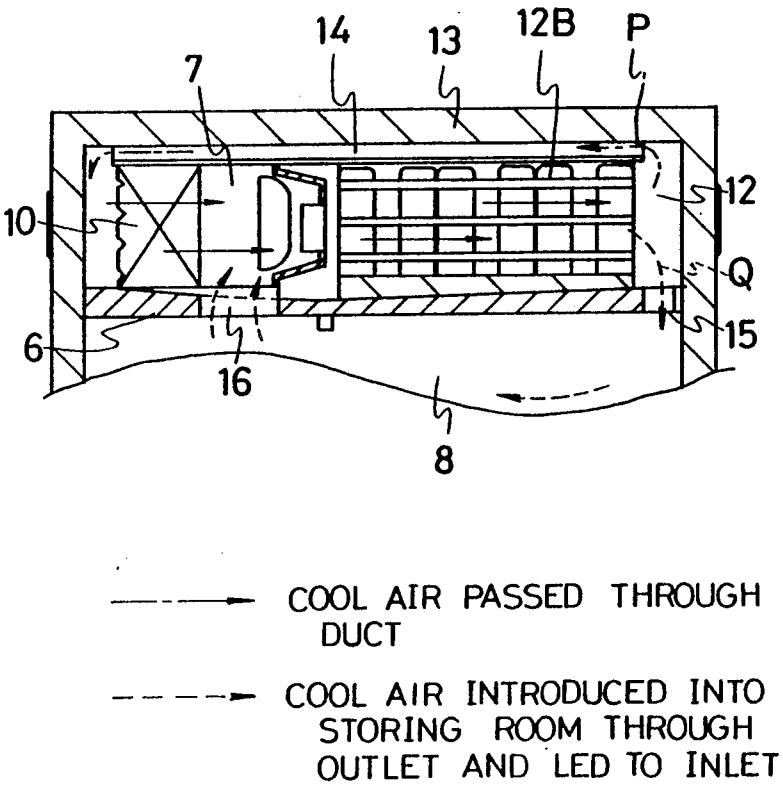
FIG. 5 is a schematic sectional view which shows the flow of cool air in the cold box.

In the freezing room 7 are disposed an evaporator 10, which forms a freezing cycle together with the compressor and condenser, which are described below, a plurality of air-blowing devices 11 and a cold-heat accumulating agent storing part 12 for housing cold-heat accumulating agents 12B. In this embodiment, the air-blowing devices 11 include two air-blowing devices 11A and one air-blowing device 11B for circulating the air in the refrigerator 1. The former are driven by an AC power supply 30 and serve as the first air-blowing means, and the latter serves as the second air-blowing means. The quantities of the air blown by the air-blowing devices 11A, 11B are set to substantially the same level. In FIG. 5, a duct 14, which has one open end on the downstream side of the cold-heat accumulating agent storing section 12 and the other open end on the upstream side of the evaporator 10, is disposed along one wall of the freezing room 7, i.e., the top wall 13 thereof. The duct 14 thus forms a cool air bypass P in parallel to the cool air circulating path Q, which will be described below.

In FIGS. 2 to 5, particularly FIG. 5, reference numeral 15 denotes an outlet which is formed at a position in the partition board 6 on the downstream side of the cold-heat accumulating agent storing section 12, and reference numeral 16 denotes an inlet which is formed in the partition board 6 so as to correspond to the air-blowing device 11B (for circulating the air in the refrigerator 1). The cool air, which has passed through the cold-heat accumulating agents 12B in the cold heat accumulating agent storing section 12, is introduced into the specification selecting room 8 through the outlet 15 and returned to the cold-heat accumulating agent storing section 12 through the inlet 16 to form the cold air circulating path Q.

A partition board 17 is disposed on the side of the evaporator 10 of the air-blowing device 11B for circulating the air in the refrigerator. The purpose of the partition board 17 is to prevent the drawing of the air, which has passed through the evaporator 10, and to prevent the air, which has been drawn from the specification selecting room 8 through the inlet 16, from moving toward the side of the evaporator 10. Furthermore, since the air quantities of all the air-blowing devices 11A, 11B are substantially the same, the ratio of the air quantity, which the air blowing device 11B (for circulating the air inside of the refrigerator) draws through the inlet port 16, to the air quantity, which is led to the side of the air inlet of the evaporator 10 through the duct 14, becomes substantially 1 : 2. The latter, or the air quantity which passes trough the cold air bypass P, can thus be increased.

Reference numeral 18 denotes an intermediate door made of a transparent material, formed in front of the cold-heat accumulating agent storing section 12, which freely opens and closes the cold-heat accumulating agent entrance.

Reference numeral 20 denotes a machine room which houses a compressor, a condenser, an air blowing device for the condenser, and the like.

An operation control device K of the refrigerator 1 will be described hereinafter with reference to FIG. 1.

Reference character L denotes an AC circuit section, and reference character M denotes a DC circuit section. Reference numeral 30 denotes a three-phase AC power supply, and reference numeral 34 denotes a compressor driving motor, which is connected to power supply lines 31 through 33.

Reference numeral 35 denotes an AC-DC converter; reference numeral 36, a first relay coil; reference numeral 37, an AC fan motor for the air-blowing devices 11A for the evaporator; reference numeral 38, an AC fan motor for the air-blowing device for the condenser; and reference numerals 39 and 40, a first switch and a second switch, respectively, for a magnet coil 52C.

Reference numeral 41 designates a freezing room temperature control section, which is a first control section. This control section 41 detects the temperature in the cold-heat accumulating agent storing section 12, and controls, on the basis of the detected temperature, the operation and stopping of the compressor driving motor 34 so as to maintain the cold-heat accumulating agent storing section 12 in the freezing room 7 at a first temperature. (One of the cold head accumulating agents to be stored in the cold-heat accumulating agent storing section 12 has a freezing temperature of −15° C., while the other has a freezing temperature of −5° C. The former is referred to as a cold-heat accumulating agent for freezing and the latter as a cold-heat accumulating agent for ice temperature cold storage.) In this embodiment, one of the above two types of cold-heat accumulating agents with different freezing temperatures is stored in the cold-heat accumulating agent storing section 12. The temperature inside of the cold-heat accumulating agent storing section 12 can be controlled at two temperatures according to the freezing temperature of the selected cold-heat accumulating agent.

Namely, reference numeral 42 denotes a first thermostat which controls the inside of the cold-heat accumulating agent storing section 12 at a temperature (−25° C.) which is 10° C. lower than the freezing temperature (−15° C.) of the cold-heat accumulating agent for freezing this cold-heat accumulating agent. (The temperature sensitive section 42*a* of the first thermostat 42 is arranged on the downstream side of the cold-heat accumulating agent storing section 12.) Reference numeral 43 denotes a second thermostat which controls the inside of the cold-heat accumulating agent storing section 12 at a temperature (−15° C.) which is 10° C. lower than the freezing temperature (−5° C.) of the cold-heat accumulating agent for ice temperature cold storage in order to freeze this cold-heat accumulating agent. (The temperature sensitive section 43a of the second thermostat 43 is arranged on the downstream of the cold-heat accumulating agent storing section 12.) Reference numeral 44 denotes the switch of a second relay coil 60 which is connected in series to the first thermostat 42. The second relay coil 60 will be described below. Reference numerals 45, 46 denote switches, which are connected to each other in parallel and which are together connected to in series to the second thermostat 43. They respectively correspond to a third relay coil 61 and a fourth relay coil 62, both of which will be explained later. A solution containing water, ethylene glycol and adhesive paste or a solution containing a natural carbohydrate, an inorganic salt, a preservative for food, a coloring agent for food etc. is used as a cold heat accumulating agent.

The DC circuit section M is separably connected to the output side of the AC-DC converter 35. Reference numeral 50 denotes a chargeable and dischargeable storage battery, which is connected to the AC-DC converter 35 through the switch 51 of the first relay coil 36.

Reference numeral 52 designates an operation section which serves as a temperature setting section. Any one of the three temperatures, i.e., a freezing temperature (e.g., −10° G. or less), the ice temperature (about −5° C. to 0° C.) and a cold storage temperature (about 1° C. to 10° C.), is selected as the temperature, i.e., the storage temperature, in the specification selecting room 8 by the operation section 52. On the basis of the state selected by the operation section 52, a storing room temperature control section 53, which serves as a second control section disposed at an appropriate place in the specification selecting room 8, is actuated, and the operation and stopping of the air-blowing device 11B (for circulating the air in the refrigerator 1) are controlled. Reference numeral 57 denotes a DC fan motor of the air-blowing device 11B, and reference numeral 58 denotes a controller for controlling the revolutions per minute and the direction of rotation of the DC fan motor 57. In this embodiment, the controller 58 causes the DC fan motor 57 to rotate in a single revolutions per minute in a single direction.

The storing room temperature control section 53 is provided with the following three thermostats: a freezing thermostat 54; an ice temperature thermostat 55; and a cold storage thermostat 56. The freezing thermostat 54 maintains the temperature in the specification selecting room 8 at a freezing temperature, e.g., −15° C., which corresponds to a first temperature. The ice temperature thermostat 55 maintains the temperature in the room 8 at the ice temperature, e.g., 0° C., which is a second temperature and which is higher than the first temperature. The cold storage thermostat 56 maintains the temperature in the room 8 at a cold storage temperature, e.g., 5° C., which is a third temperature and which is higher than the second temperature. Any one of the three thermostats is selected by the selecting operation of the operation section 52 in order to maintain the temperature in the specification selecting room 8 at the selected temperature.

Reference numeral 59 denotes a group of relays connected in parallel to the series circuit comprising the storing room temperature control section 53 and the air-blowing device 11B (for circulating the air in the refrigerator). Reference numeral 60 denotes a second relay coil corresponding to the freezing thermostat 54; reference numeral 61, a third relay corresponding to the ice temperature thermostat 55; and reference numeral 62, a fourth relay coil corresponding to the cold storage thermostat 56.

Further, although this embodiment concerns an example in which the each of the temperature control sections 41, 53 comprises the thermostat, a thermistor may be disposed in each of the freezing room 7 and the specification selecting room 8 so that the operation and stopping of the compressor driving motor 34 and the air-blowing device 11B (for circulating the air in the refrigerator) in correspondence with the detection signal from each of the thermistors and the temperature selected by the operation section 52 (specifically, one of the freezing, cold storage and ice temperatures). Reference character H denotes a defrosting heater.

The cooling of the freezing room 7 and the specification selecting room 8 will now bee described below on the basis of the foregoing structure, provided that the insides of both the rooms are in the state where they are not cooled.

If the freezing temperature is selected by the operation section 52, the freezing thermostat is selected by this selection. When a cooling operation switch (not shown) is depressed, or a power supply plug is put into the socket (both the plug and socket not shown), an electric current is caused to flow through the first relay coil 36 in order to close the switch 51. As a result, the storage battery 50 is charged, and a current is caused to flow through the air-blowing device 11B (for circulating the air in the refrigerator) as well as through the second relay coil 60. At the same time, a current is caused to flow through not only the magnet coil 52C not only the compressor driving motor 34, the AC fan motors 37, 38. The operations of all the above components is started.

Accordingly, the inside of the cold-heat accumulating agent storing section 12 is gradually cooled by the air, which has become cooled after passing through the evaporator 10, and the cold-heat accumulating agents 12B freeze. Furthermore, the inside of the specification selecting room 8 is gradually cooled by the latent head of melting of the cold-heat accumulating agents 12B, once the air-blowing device 11B (for circulating the air in the refrigerator) starts operating.

At this time, the cool air which has led to the downstream side of the cold-heat accumulating agents 12B in the cold-heat accumulating agent storing section 12 is divided into the following two flows. One flow forms a path, or cool air circulating path Q (hereinafter referred to as a cool air flow (X)), in which the air flows into the specification selecting room 8 through the outlet 15 and returns to the cold-heat accumulating agent storing section 12 through the inlet 16. The other flow forms a path, or cool air bypass P (hereinafter referred to as a cool air flow (Y)), in which the air returns to the upstream side of the evaporator 10 via the duct 14 and then to the cold-heat accumulating agent storing section 12 after having been cooled by the evaporator 10.

Moreover, as has been described above, since the air quantity of the cool air flow (Y) of the two flows is large, and since the cool air can be directly introduced into the evaporator 10, without having nearly been heat-exchanged after having passed through the cold-heat accumulating agents 12B, the increase in the temperature of the air returning to the evaporator 10 is restricted. For these reasons, the heat-exchange capacity of the evaporator 10 is not lowered, and yet air cooler than before can be blown to the cold-heat accumulating agents 12B. Further, the cooling efficiency of the cold-heat accumulating agents 12B is increased, and the time required for freezing the cold-heat accumulating agents 12B can be shortened, as compared with the time for freezing the cold-heat accumulating agents of the conventional forced convection type.

When the temperature in the specification selecting room 8 falls as low as the open operation temperature of the thermostat 54 (which is set to −16° C. in this embodiment), the contact of the thermostat 54 is opened so as to stop the air-blowing device 11B (for circulating the air in the refrigerator), and the forced convection of the cool air in the specification selecting room 8 is stopped. This cessation of the forced convection of the cool air causes the forced freezing in the room 8 to stop, and therefore the temperature gradually rises. On the contrary, when the temperature in the room 8 rises as high as the return operation temperature of the thermostat 54 (which is set to −14° C. in this embodiment), the contact of the thermostat 54 is closed so as to re-start the air-blowing device 11B (for circulating the air in the refrigerator), and further cool the specification selecting room 8 by the forced convection. The specification selecting room 8 is kept at the freezing temperature by repeating the above-mentioned operation.

When the ice temperature or the cold storage temperature is selected by the operation section 52, the operations for both of the two temperatures are the same as those described above, except that operations for "the freezing temperature" and "for freezing" with "ice temperature" and "for ice temperature" or with "cold storage temperature" and "for cold storage". The explanations of the two temperatures are therefore omitted. However, since there is the temperature relationship where freezing < ice temperature < cold storage, the operation temperatures of the thermostats are different from each other corresponding to the temperature relationship. The time up to the stopping of the air-blowing device 11B (for circulating the air in the refrigerator) decreases, with an increase in the control temperature. As a result, when one of the two temperatures is selected, the air quantity of the air-blowing device 11B becomes small.

Since the cool air is introduced through the duct 14 from the outlet side of the cold-heat accumulating agent storing section 12 to the air inlet of the evaporator 10, the duct 14 serves as a bypass for the cool air and promotes the cooling in the cold-heat accumulating agent storing section 12. The cooling in the cold-heat accumulating agent storing section 12 is promoted, particularly because the quantity of the cool air flowing through the cool air flow (Y) is larger than that of the cool air flowing through the cool air flow (X). Moreover, since the cool air flowing through the cool air flow (Y) returns directly to evaporator 10, without passing through the specification selecting room 8 at a relative humidity less than that of the cool air flow (X), the amount of frosting for the evaporator 10 per unit time is decreased and thus the necessity for defrosting is made less frequent.

Furthermore, when the cold-heat accumulating agent storing section 12 gradually cools and the temperature in the storing section 12 falls to the open operation temperature (which is set to −26° C. in this embodiment) of the first thermostat 42, the contact of the thermostat 42 is opened so as to stop the compressor driving motor and stop the cooling of the freezing room 7. This prevents the over-cooling of the freezing room 7. The air-blowing device 11A for the evaporator 10, however, keeps operating because an electric current flows through the AC fan motor 37. At the stopping of the cooling, when the temperature in the cold-heat accumulating agent storing section 12 gradually rises to a temperature higher than the return temperature (which is set to −24° C. in this embodiment) of the first thermostat 42, the contact of the thermostat 42 is closed so as to again drive the compressor for cooling the freezing room 7. By repeating the above-mentioned operation, the inside of the cold-heat accumulating agent storing section 12 is kept at a temperature (−25° C. in this embodiment) lower than the freezing temperature of the cold-heat accumulating agents for freezing.

When the ice temperature or the cold storage temperature is selected by the operation section 52, the operation of the second thermostat 43 in the freezing room 7 is the same as that of the first thermostat 42, except that the first thermostat 42 is replaced with the second thermostat 43. The explanation of the operation of the second thermostat 43 is therefore omitted.

As has been described in detail, in the present invention, since the cool air cooled by the cold-heat accumulating agents is divided into the cool air circulating path for forcing the cool air to circulate to the specification selecting room 8 and the cool air bypass returned to the evaporator 10, the specification selecting room 8 can be cooled, while the cold-heat accumulating agents 12B being frozen. Further, the provision of the first and second control sections permits the separate control of the temperatures of the specification selecting room and of the freezing room. Furthermore, since the first and second control sections are operated at the first temperature, which is set by the temperature setting section, and the second temperature, which is higher than the first temperature, or the third temperature, which is higher than the second temperature, the temperature in the freezing temperature and the temperature in the specification selecting room can be controlled by the first control section and the second control section, respectively. The temperature in the specification selecting room can be thus controlled regardless of freezing and non-freezing of the cold-heat accumulating agents, the temperature of the commodities in the specification selecting room can be controlled during freezing of the cold-heat accumulating agents.

Embodiment 2

A description will now be given of a case in which two cold-heat accumulating agents 12A, 12B having different freezing temperatures are used as the cold-heat accumulating agents stored in the freezing room 7.

The cold-heat accumulating agent 12A has freezing temperature of −25° C., and the cold-heat accumulating agent 12B has a freezing temperature of −5° C. The former is referred to as a cold-heat accumulating agent for freezing, and the latter is referred to as a cold-heat accumulating agent for ice temperature and cold storage hereinafter.

Figure 6:
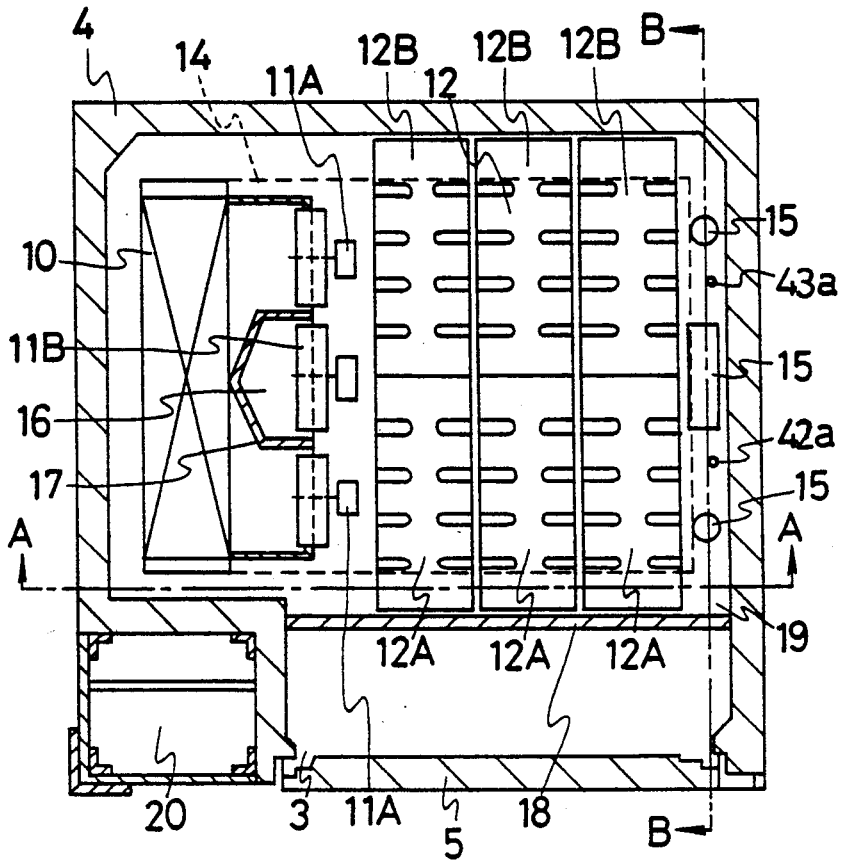
FIG. 6 is a drawing corresponding to FIG. 3 in which two cold-heat accumulating agents having different freezing temperatures are used.

A plurality of such two types of cold-heat accumulating agents 12A, 12B (which are mixed at a predetermined ratio) are stored in the cold-heat accumulating agent storing section 12. In FIG. 6, four cold-heat accumulating agents 12A and two cold-heat accumulating agents 12B are disposed, the latter being disposed on the air-blowing device side. The temperature in the cold-heat accumulating agent storing section 12 can be controlled to a temperature corresponding to the operation mode of the operation section 12, which will be described below, in correspondence with the freezing temperatures (melting temperatures) of the cold-heat accumulating agents. The freezing temperatures of the cold-heat accumulating agents 12A, 12B can be actually made different from each other by changing the concentration of the freezing-pint depressant, i.e., ethylene glycol/paste or a natural carbohydrate/an inorganic salt.

A thermostat, which can control the temperature in the cold-heat accumulating agent storing section 12 to a first temperature (−35° C.), which is lower by a predetermined temperature (e.g., 10° C.) than the freezing temperature (−25° C.) of the cold-heat accumulating agent 12A for freezing this accumulating agent 12A, is selected as the first thermostat 42.

A thermostat, which can control the temperature in the cold-heat accumulating storing section 12 to a second temperature (−15° C.) which is lower by a predetermined temperature (e.g., 10° C.) than the freezing temperature (−5° C.) of the cold-heat accumulating agent 12B for ice temperature cold storage for freezing this agent 12B, is selected as the second thermostat 43.

The operation section 52 used is provided with a temperature setting section comprising a mode selecting section for selecting one of first, second and third modes. Namely, in a case (1) where the first mode is selected, the temperature in the freezing room 7 is controlled to the first temperature (−35° C.) which allows the freezing of the cold-heat accumulating agent 12A for freezing, and the temperature in the specification selecting room 8 is controlled to a fourth temperature (−18° C.), or the freezing temperature (e.g., −10° C. or less), which is higher than the first temperature and which allows the freezing of the stored commodities. In a case (2) where the second mode is selected, the temperature in the freezing room 7 is controlled to the second temperature which is higher than the first temperature (−15° C.) and which allows the freezing of the cold-heat accumulating agent 12B for ice temperature cold storage, and the temperature in the specification selecting room 8 is controlled to a fifth temperature (0° C.), i.e., the ice temperature (about −5° C. to 0° C.), which is higher than the second temperature and is 0° C. or less and which is lower than the freezing temperature of the stored commodities. In a case (3) where the third mode is selected, the temperature in the freezing room 7 is controlled to the second temperature, and the temperature of the specification selecting room 8 is controlled to the third temperature (5° C.), i.e., the cold storage temperature (about 1° C. to 10° C.), which is higher than the fifth temperature.

On the basis of the selection by the operation section 52, the freezing room temperature control section 41 disposed at an appropriate position in the freezing room 7 is actuated, and the storing room temperature control section 53, which is disposed at an appropriate position in the specification selecting room 8 and which serves as a temperature control device, is actuated. The quantity of blown air per unit time is controlled by controlling the operation and stopping of the compressor driving motor 34 and the operation and stopping of the air-blowing device 11B (for circulating the air in the refrigerator).

Reference numeral 57 denotes a DC fan motor, and reference numeral 58 denotes a controller for controlling the number of revolutions and the direction of rotation of the DC fan motor 57. In this embodiment, however, the controller 58 causes the DC fan motor 57 to rotate at a single revolutions per minute in a single direction.

The storing room temperature control section 53 is provided with three thermostats: a freezing thermostat 54; an ice temperature thermostat 55; and a cold storage thermostat 56. The freezing thermostat 54 maintains the temperature in the specification selecting room 8 at the fourth temperature (−18° C.). The ice temperature thermostat 55 maintains the temperature at the fifth temperature (0° C.). The cold storage thermostat 56 maintains the temperature at the third temperature (5° C.). Any one of the above three thermostats is selected by the selecting operation of the operation section 52 so that the air-blowing device 11B (for circulating the air in the refrigerator) (more specifically, the air quantity) is controlled, and the temperature in the specification selecting room 8 is maintained at the selected temperature.

The cooling of the freezing room 7 and the specification selecting room 8 is described below on the base of the foregoing structure. However, since a case, where the first mode is selected, is described above in the first embodiment, such a case is not described below. After all, the temperature in the cold-heat accumulating agent storing section 12 is maintained at the first temperature (−35° C. in this embodiment), which is lower than the freezing temperature of the cold-heat accumulating agent for freezing.

When the second or third mode is selected by the operation section 52, the operation is the same as the above-mentioned operation of the specification selecting room 8, except that "for freezing" is replaced with "ice temperature or for ice temperature" or "cold storage or for cold storage", and that the first thermostat described in the operation for freezing is replaced with the second thermostat. Such a case is therefore not described below. When the second mode is selected, the cold-heat accumulating agent storing section 12 is maintained at −15° C., and the specification selecting room 8 is maintained at 0° C. When the third mode is selected, the cold-heat accumulating agent storing section 12 is maintained at −15° C., and the specification selecting room 8 is maintained at 5° C.

Since there is the temperature relationship, freezing < ice temperature < cold storage, however, the operation temperatures of the thermostats are different from each other corresponding to the temperature relationship. The time up to the stopping of the air-blowing device 11B (for circulating the air in the refrigerator) decreases, with a increase in control temperature. As a result, the air quantity of the air blowing device 11B becomes small.

The above embodiment concerns a case where the specification selecting room 8 is maintained in any one of the three temperature zones, i.e., the freezing, ice temperature and cold storage temperature zone. However, two temperature zones, e.g., (I) freezing and ice temperature, (II) ice temperature and cold storage, or (III) freezing and cold storage, may be combined so that either of the temperature zones can be selected. In this case, the cold box does not have the three temperature zones described in the above embodiment, but has two temperature zones. The temperature control device and the other circuit arrangement can be thus significantly simplified.

In the above-mentioned arrangement, the cold-heat accumulating agents 12A and 12B are frozen by the cooling device 14 provided in the cold box 1, and the specification selecting room 8 is cooled by the melting latent heat of the cold-heat accumulating agents. Furthermore, the operation and stopping of the compressor driving motor 34 are controlled, and the air quantity per unit time of the air-blowing device 11B (for circulating the air in the refrigerator) is controlled, in correspondence with the operation mode 1, 2 or 3, which is selected by the operation section 52. A single cold box can be thus used in a plurality of temperature zones, i.e., a temperature zone where commodities are frozen and a temperature zone where commodities are not frozen.

Further, the use of this cold box 1 has no need for other specific cold box in collection and distribution places and relay points during transportation and thus permits an attempt to be made to reduce the equipment in the transportation system. Furthermore, since the air-blowing device 11B (for circulating the air in the refrigerator) has a forced convention system, the temperature distribution in the specification selecting room is uniform. It is therefore possible to satisfactorily cope with a case where the storing room is maintained in the ice temperature zone.

Furthermore, since the air-blowing device 11B (for circulating the air in the refrigerator) is divided from the air-blowing devices 11A for the evaporator so that the air drawn in through the inlet 16 is led to the cold-heat accumulating agents 11A and 11B without being passed through the evaporator 10, it is possible to prevent the air containing moisture from returning directly to the evaporator 10. In addition, the air led to the cold-heat accumulating agents is mixed with the air passed through the evaporator 10 so that the air at a temperature, which is close to the temperature in the refrigerator, is blown to the specification selecting room 8 from the outlet 15. It is therefore possible t prevent the over-cooling of the commodities disposed near the outlet 15, which is easily caused in the conventional method.

In addition, since both the cold-heat accumulating agents 12A for freezing and the cold-heat accumulating agents 12B for ice temperature cold storage are stored in the cold-heat accumulating agent storing section 12, even if the operation mode is changed by the operation section 52, the cold-heat accumulating agents in the cold-heat accumulating agent storing section 12 need not be replaced with other cold-heat accumulating agents. The operation properties of the cold box in accordance with the present invention is thus significantly improved, and the maintenance of thereof can be easily performed.

Figure 7:
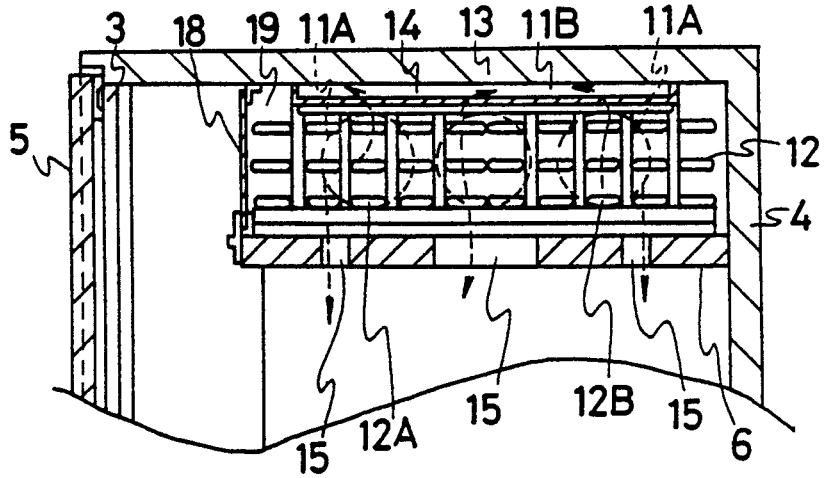
FIG. 7 is a sectional view of a principal portion taken along the line B—B of FIG. 6.
Figure 8:
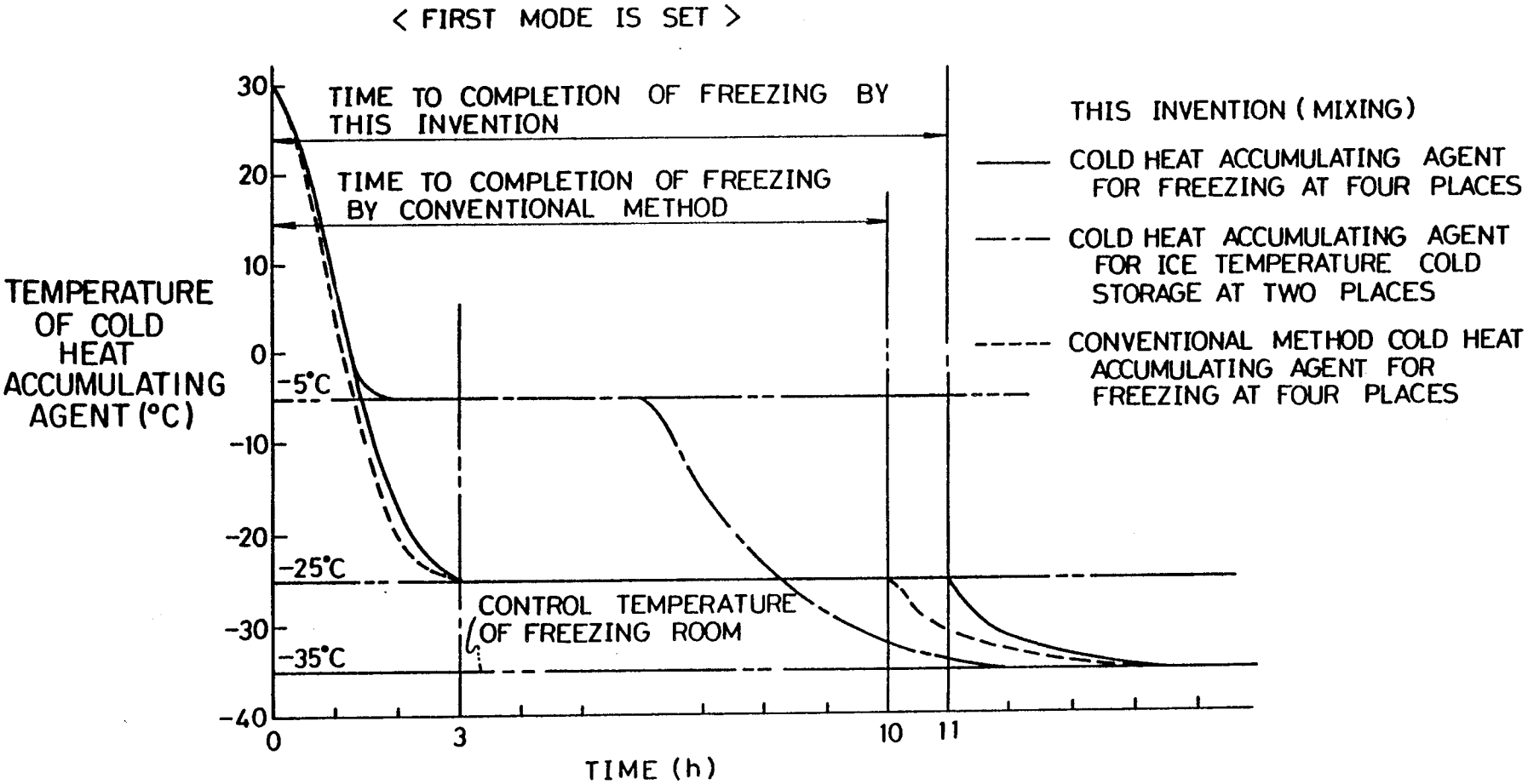
FIGS. 8 and 9 are temperature-time graphs each of which shows the temperature change of the cold-heat accumulating agents and the required time in an operation mode.
Figure 9:
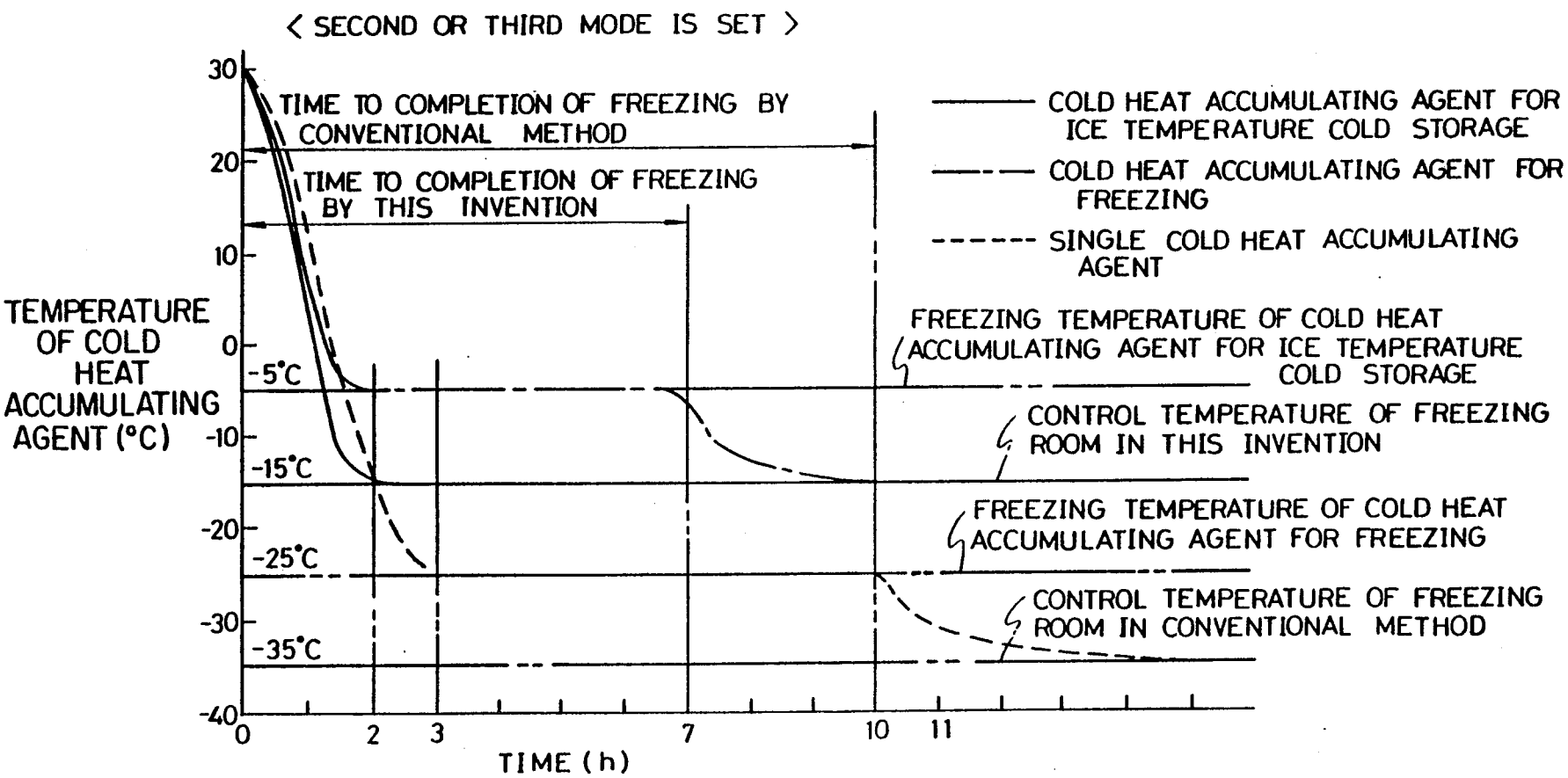

Further, since the cold-heat accumulating agents having different freezing temperatures are mixed so that the control temperature zone of the freezing room 7 can be changed by changing the operation mode, the time taken for freezing the cold-heat accumulating agents can be reduced when the second mode (2) or the third mode (3), both of which are frequently used in the cold store 1, is selected, as shown in FIG. 7. It is also possible to prevent the over-cooling or insufficient cooling of the cold-heat accumulating agents, prevent the over-cooling of the freezing room 7 and the specification selecting room 8 and improve the usability of the cold box.

As described above, in the present invention, since a plurality of kinds of cold-heat accumulating members (i.e., cold-heat accumulating agents for freezing and cold-heat accumulating agents for ice temperature cold storage) having different freezing temperatures corresponding to the operation modes are mixed in the freezing room, even if the the operation mode is changed by the temperature setting section, the cold-heat accumulating agents in the freezing room need not be replaced with other cold-heat accumulating agents. Namely, it is sufficient to change the present operation mode of the temperature setting section to another operation mode. Thus, the operation properties of the cold store are significantly improved, and the maintenance thereof can be easily performed.

In addition, since the cold-heat accumulating agents having different freezing temperatures are mixed so that the control temperature zone of the freezing room can be changed by changing the operation mode, the time taken for freezing the cold-head accumulating agents can be reduced when the second mode (2) or the third mode (3), both of which are frequently used in the cold store, is selected. It is also possible to prevent the over-cooling or the insufficient cooling of the cold-heat accumulating agents, prevent the over-cooling of the freezing room and the storing room and improve the usability of the cold store.

As described above, the cold-heat accumulating agents stored in the cold-heat accumulating agent storing section 12 and the commodities stored in the specification selecting room 8 are previously cooled to a predetermined temperature at a station. The refrigerator 1 is then loaded on a truck, and the DC fan motor 57 is actuated only by the charge battery 50 of the DC circuit section M. The commodities in the specification selecting room 8 are thus transported to a destination, while being maintained at the set temperature zone.

The cold-heat accumulating agents 12B can be charged in and discharged from the cold-heat accumulating agent storing section 12. Frozen commodities can be thus stored in the section 12 at the station in place of the cold-heat accumulating agents.

What is claimed is:

1. A cold box comprising:

a freezing room;

a cold-heat accumulating agent stored in said freezing room;

a commodity storing room separated from said freezing room;

an evaporator connected with a compressor to form a freezing cycle;

first air-blowing means for circulating a first cooled air flow between said evaporator and said freezing room, said cooled air flow cooling said cold-heat accumulating agent;

second air-blowing means for circulating a second cooled air flow between said freezing room and said commodity storing room, said second cooled air flow being cooled by heat transfer between said second air flow and said cold-heat accumulating agent;

an operation control device for directing said compressor, said first air-blowing means and said second air-blowing means to operate; and said operation control device comprising temperature setting means for setting a freezing temperature for said freezing room and a storing temperature for said storing room, first control means for detecting the temperature in said freezing room and directing said compressor to stop operating when the detected temperature is not higher than said set freezing temperature, and second control means for detecting the temperature in said storing room and directing said second air-blowing means to stop operating when the detected temperature is not above said set storing temperature.

2. A cold box according to claim 1, wherein said temperature setting means comprises a selection setting section for setting one storing temperature by selecting one of the freezing temperature at which said commodity is frozen and the temperature at which said commodity is cooled, without being frozen.

3. A cold box according to claim 2, wherein said cooling temperature is one of the ice temperature and a cold storage temperature.

4. A cold box according to claim 1, wherein said first control means includes a first thermostat having a temperature sensitive section disposed in said freezing room, said first control means outputting a signal for operating and stopping said compressor, and said second control means includes a second thermostat having a temperature sensitive section disposed in said storing room, said second control means outputting a signal for operating and stopping said second air-blowing means.

5. A cold box according to claim 1, wherein a plurality of cold-heat accumulating agents having different freezing temperatures are stored in said freezing room for cooling by said first cooled air flow.

6. A cold box according to claim 5, wherein said temperature setting means comprises a mode selecting section for selecting any one of the following three operation modes:

i) a first mode in which the temperature in said freezing room is controlled to a first temperature, and the temperature in said storing room is controlled to a fourth temperature which is higher than said first temperature;

ii) a second mode in which the temperature in said freezing room is controlled to a second temperature which is higher than said first temperature, and the temperature in said storing room is controlled to a fifth temperature which is higher than said second temperature;

iii) a third mode in which the temperature in said freezing room is controlled to said second temperature, and the temperature in said storing room is controlled to a third temperature which is higher than said fifth temperature.

7. A cold box according to claim 1, wherein said cold heat accumulating agent is one of a solution of water, ethylene glycol and a paste, and a solution of a natural carbohydrate, an inorganic salt, a preservative for food and a coloring agent for food.

* * * * *